United States Patent [19]

Ogura

[11] Patent Number: 4,503,407

[45] Date of Patent: Mar. 5, 1985

[54] DISPLAY APPARATUS INCORPORATED IN AN IMAGE-FORMING APPARATUS

[75] Inventor: Masahiko Ogura, Fujisawa, Japan

[73] Assignee: Tokyo Shibaura Denki Kabushiki Kaisha, Kawasaki, Japan

[21] Appl. No.: 511,195

[22] Filed: Jul. 6, 1983

[30] Foreign Application Priority Data

Jul. 9, 1982 [JP] Japan ..... 57-104114[U]
Dec. 27, 1982 [JP] Japan ..... 57-195352[U]

[51] Int. Cl.[3] ..... G03G 15/00

[52] U.S. Cl. ..... 355/14 C; 355/14 SH; 340/765; 340/784

[58] Field of Search ..... 355/14 C, 14 R, 3 R, 355/3 SH, 14 SH; 340/715, 765, 784

[56] References Cited

U.S. PATENT DOCUMENTS 4,176,941 12/1979 Breitenkam et al. ..... 355/14 R
4,390,872 6/1983 Murakami et al. ..... 355/14 R
4,408,869 10/1983 Tomosada et al. ..... 355/14 C

FOREIGN PATENT DOCUMENTS 3324592 1/1984 Fed. Rep. of Germany .

*Primary Examiner*—R. L. Moses
*Attorney, Agent, or Firm*—Cushman, Darby & Cushman

[57] ABSTRACT

A display apparatus is incorporated in an image-forming apparatus such as an electrophotographic copying machine. The display apparatus comprises a display device which pictorially displays component segments of said image-forming apparatus, the component segments defining at least the paper path and the outlines of the image-forming apparatus, an oscillator for producing drive pulses "A" and complementary drive pulses "B", a processor from which a data signal is derived based upon a predetermined program, a latch signal and a clock pulse signal respectively, and a display driving circuit which receives the drive pulses "A" and the complementary drive pulses "B" so as to drive the display device under the control of the data signal, whereby the processor controls the display device to display on the component segments a present position of sheets of paper in synchronism with the paper movement by calculating the clock pulse signal.

8 Claims, 18 Drawing Figures

DISPLAY APPARATUS INCORPORATED IN AN IMAGE-FORMING APPARATUS

BACKGROUND OF THE INVENTION

This invention relates to a display apparatus for an image-forming apparatus such as an electrophotographic copying machine or printing machine, which can display where paper sheets are being moved within the image-forming apparatus.

For example in an electrophotographic copying machine in which sheets of paper are transported in turn so as to transfer the latent images of the original documents onto them, the operator cannot directly observe how the paper is transported in the paper convey path. Moreover, one can only determine that the paper is actually being conveyed by listening to operation noises of the copying machine or observing the exposure lamps. When the paper convey operation is interrupted because a paper jam occurs or the interruption key is actuated, it is rather difficult to find out the exact position of the conveyed paper, resulting in inconvenience to the operator.

If a predetermined time has passed since the beginning of the copying operation, and the copied paper is not delivered from the copying machine, it is impossible to tell where the paper is jammed. Accordingly, quick repair cannot be realized, which makes maintenance difficult.

A first object according to the present invention is to provide a display apparatus in which both the image-forming operation and the paper conveying condition can be very easily recognized.

A second object according to the present invention is to provide a display apparatus which can display the position of a piece of paper, and thus, a paper jam in the paper convey path.

SUMMARY OF THE INVENTION

In a display apparatus according to the invention, there are provided: display means which pictorially displays component segments of said image-forming apparatus, said component segments defining at least said paper path and the outlines of said image-forming apparatus; means for oscillating drive pulses and complementary drive pulses: processing means from which a data signal is derived based upon a predetermined program, a latch signal and a clock pulse signal respectively; and display driving means which receives said drive pulses and said complementary drive pulses so as to drive said display means under the control of said data signal, whereby said processing means controls said display means to display on said component segments a present position of sheets of paper in synchronism with the paper movement by calculating said clock pulse signal.

Further, in a display apparatus according to the invention, there are provided: display means which pictorially displays component segments of said image-forming apparatus, said component segments defining at least said paper path, and the outlines of said image-forming apparatus; means for oscillating drive pulses and complementary drive pulses; processing means from which a data signal is derived based upon a predetermined program, a latch signal and a clock pulse signal respectively; and display driving means which receives said drive pulses and said complementary drive pulses so as to drive said display means under the control of said data signal, whereby said processing means controls said display means to display on said component segments a flow of sheets of paper during the paper movement.

BRIEF EXPLANATION OF THE DRAWINGS

The invention will be best understood with reference to the accompanying drawings, in which.

DETAILED DESCRIPTION OF THE PREFERRED EMBODIMENTS

Figure 1:
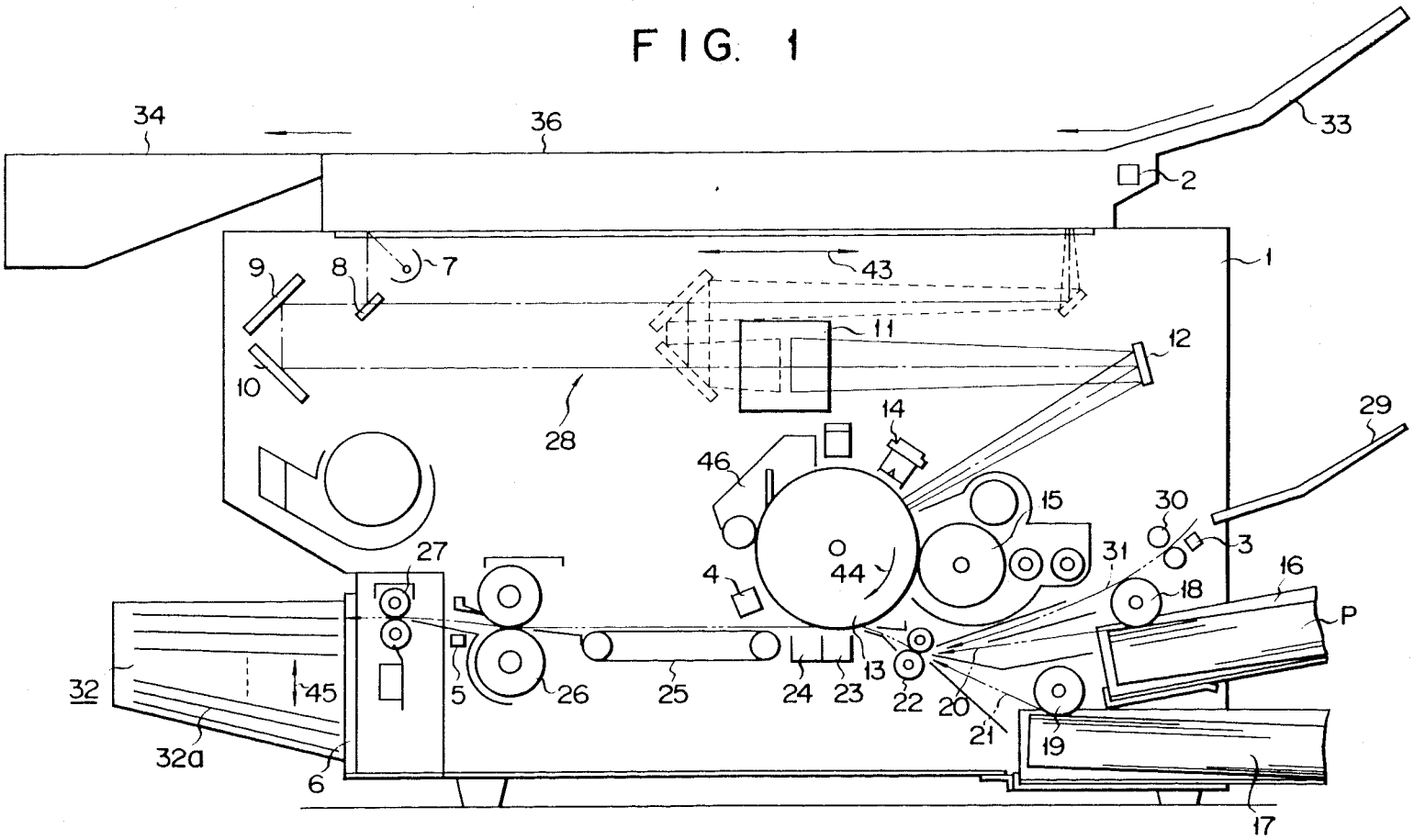
FIG. 1 shows a schematic diagram of an electrophotographic copying machine including a display apparatus according to the invention.
Figure 2:
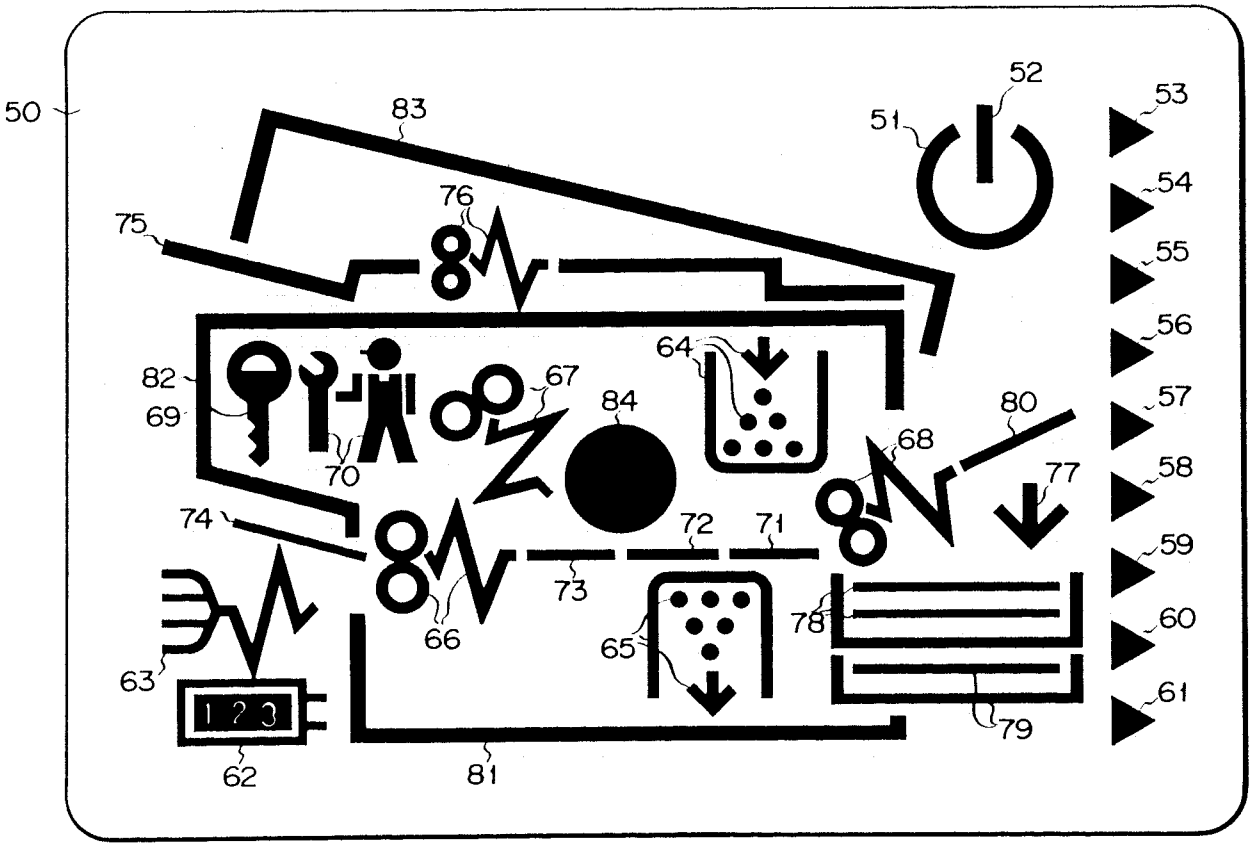
FIG. 2 shows a pictorial schematic diagram of the display section according to the invention.
Figure 3:
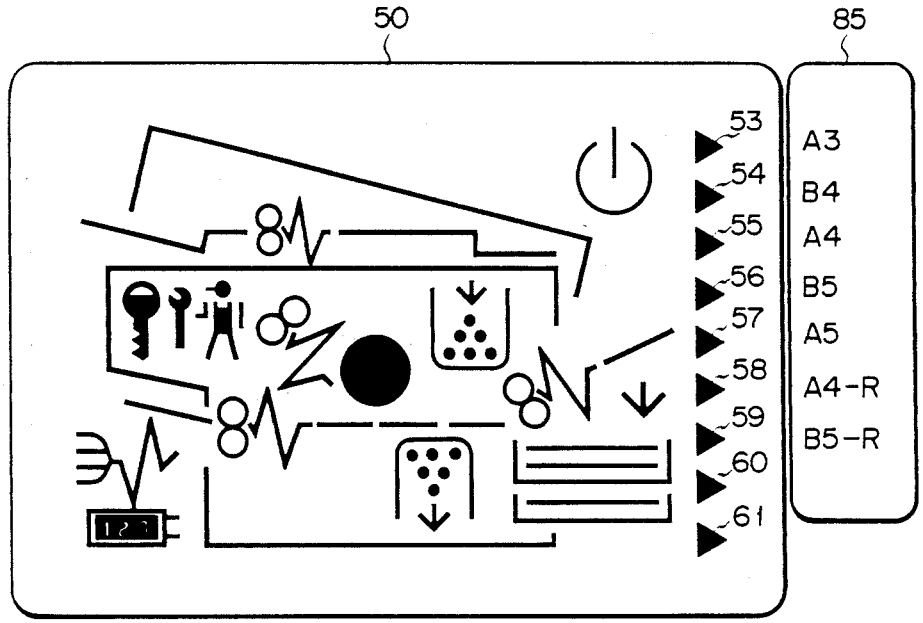
FIG. 3 shows a pictorial schematic diagram of the display section combined with a paper size display.
Figure 4:
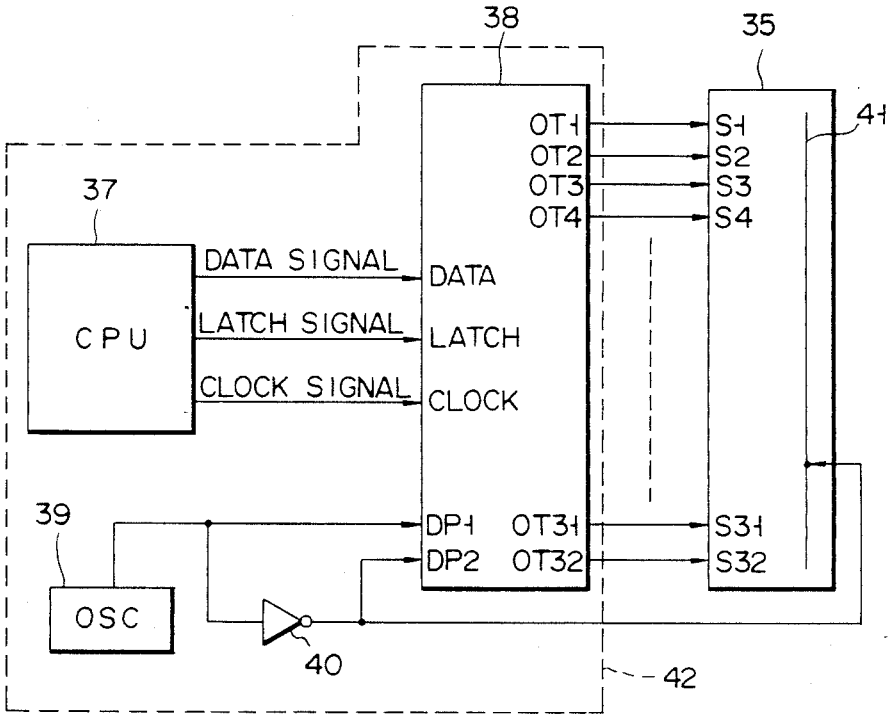
FIG. 4 is a functional logic diagram of the display control circuit.

Preferred embodiments according to the invention will now be described with reference to the drawings. FIG. 1 shows a schematic diagram of an electrophotographic copying machine which includes the present invention. FIG. 2 shows a pictorial schematic diagram of a display section of a display apparatus according to the invention. FIG. 3 shows a pictorial schematic diagram of the display section combined with a paper size display. FIG. 4 is a functional logic diagram of the display control circuit.

Referring to FIG. 1, a schematic diagram of an electrophotographic copying machine provided with the display apparatus will be explained.

In FIG. 1, reference numeral 1 denotes a machine housing on the upper surface of which a document supporter 36 is provided to support documents. Under the document supporter 36 there is provided an optical system 28 consisting of an exposure lamp 7, mirrors 8, 9 and 10, lens 11 and mirror 12. The copying surface of the above-mentioned document is optically scanned, in a direction shown by an arrow 43, by the optical system 28, so that an image of the document is formed on a photosensitive drum 13. The photosensitive drum 13 rotates in a direction shown by an arrow 44 so as to perform the electrophotographic operation as follows. The surface of the drum 13 is charged by a charge electrifier, or a charger 14, and then images of the documents are exposed by a slit on the drum surface. As a result, electrostatic latent images (referred to "latent images" hereinafter) are formed on the drum surface, and thereafter become visual images by adding toner thereon by means of a developer 15.

Meanwhile a sheet of paper P is selectively fed from either an upper paper supply cassette 16, or a lower paper supply cassette 17, one by one, by a feed roller 18 or 19. It is guided to a register roller 22 through a paper guide path 20 or 21, which feeds a sheet of paper P to a transfer section. The upper and lower paper supply cassettes 16 and 17 are detachably mounted on the right lower portion of the machine housing 1, one of which is selectable by an operation panel (not shown). Reference numeral 29 denotes a hand feed-in type paper supply cassette. Sheets of paper P are set on the hand feed-in type paper supply cassette 29, so that they are guided through a feed roller 30 and a paper guide path 31 to the above-mentioned register roller 22.

A sheet of paper P which was fed through either paper path closely contacts the surface of the photosensitive drum 13 at the transfer charge electrifier 23, so that the toner image formed on the photosensitive drum 13 can be transferred onto a sheet of paper P. The paper sheet P on which the toner image has been transferred is left from the photosensitive drum 13 by means of a separating charge electrifier 24, and is conveyed by a paper convey belt 25 to a fixing roller pair 26 as a fixing device which is positioned at the end of the convey belt 25, whereby the transferred toner image is fixed on the paper sheet P by passing the paper sheet through the fixing device. The paper sheet P which has been fixed is delivered into a sorting device 32 which is mounted outward on the machine housing 1 equipped with a delivery roller pair 27. In the sorting device or sorter 32 a plurality of bins 32*a* are positioned parallel to each other. Those bins 32*a* may be moved in the vertical direction shown by an arrow 45, which defines a plurality of storing spaces into which the paper sheets P are stored in turn.

On one end of the document feeder 36 in the longitudinal direction, a document feeding section 33 is formed which stores the documents to be copied and also feeds them to the document feeder 36. Meanwhile, on other end of the document feeder 36, a document holding section 34 is formed to hold the document which has been transported by rollers (not shown) within the document feeder 36 after making the desired number of copies for the document.

Description will now be given of detectors 2 to 6 which are positioned in a paper convey path within the housing 1 so as to detect a paper jam, i.e., a failure of paper sheets to properly travel along a predetermined paper path within the copying machine. Those detectors 2 to 6 are of the optical reflection type. The detector 2 is arranged in the document feeding section 33 to detect a paper jam occurring during the paper conveying process. The detector 3 is positioned in the paper path corresponding to the hand feed-in type paper supply cassette 29 so as to detect such trouble in this paper path. The detector 4 is provided around the periphery of the photosensitive drum 13 near the separating charge electrifier 24 in order to determine that paper sheets P are attached to the photosensitive drum 13. The detector 5 positioned in the paper path near the fixing roller 26 detects a paper jam occurring in the vicinity of the fixing roller 26. The final detector 6 is positioned in the sorting device 32 so as to detect a paper jam in the sorting device 32.

FIG. 2 shows a pictorial diagram of component segments (referred to "segments"hereinafter) which represent the components and the outlines of the copying machine 1 and also the document feeder 3 and are made by the liquid crystal element. Reference numeral 50 denotes a display panel of the liquid crystal element, and numerals 51 and 52 display pictorial segments for indicating whether the machine is ready for copying. The segment 51 indicates that the machine is ready for use, and the segment 52 indicates that the machine is not yet ready for use, i.e., is warming up. Reference numerals 53 to 61 denote sizes of the paper sheets P, reference numeral 62 indicates a pictorial segment for showing a key counter setting, reference numeral 63 denotes a pictorial segment which warns of a paper jam occurring in the sorting device 32, reference numeral 64 is a pictorial segment which indicates that the toner in the toner hopper of the developer has been depleted, reference numeral 65 is a pictorial segment which indicates that the toner collector is filled with the collected toner, reference numeral 66 is a pictorial segment which warns of a paper jam occuring either in the fixing roller pair 26 or the paper path in the vicinity thereof. Reference numeral 67 is a pictorial segment which warns of a paper jam when the paper sheet P is attached to the photosensitive drum 13 or has entered the cleaner 46, reference number 68 is a pictorial segment which indicates a paper jam occurring in the paper path of the hand feed-in type paper cassette 29, reference number 69 is a pictorial segment which indicates the need to summon a key operator, reference numeral 70 is a pictorial segment which indicates the need to summon a repair engineer, and reference numerals 71, 72, 73 and 74 are pictorial segments by which the paper locations are indicated. That is, the segment 71 indicates that the paper sheet P is located near the register roller pair 22, the segment 72 indicates that it is present in front of or near the photosensitive drum 13, the segment 73 denotes that it is now in the vicinity of the paper delivery section or in the paper path, and the segment 74 denotes that it is now in the delivery tray or the first storing section 32*a* of the sorting device 32. These segments 71 to 74 are sequentially turned on (illuminated) in synchronized with, or independent of the paper convey speed.

It should be noted that the meaning of "synchronization illumination condition of the segments" is that the corresponding segment 71, 72, 73 or 74 is illuminated by discriminating the present position of the paper sheet P in the paper path by counting clock pulses derived from the internal timer (not shown) of the machine 1 from the beginning of the exposure process. The segments 71 to 74 are in turn illuminated during the paper conveying process after the beginning of the exposure process, which means "independent illumination condition of the segments".

Reference numeral 75 is a pictorial segment for the document supporter 36; reference numeral 76 is a pictorial segment for indicating a paper jam occurring in the document supporter 36; reference numeral 77 is a pictorial segment which indicates that sheets of paper P are depleted in either the upper paper supply cassette 16 or the lower paper supply cassette 17; reference numeral 78 is a pictorial segment to indicate that the upper paper supply cassette 16 has been selected; reference numeral 79 is a pictorial segment to indicate that the lower paper supply cassette 17 has been selected; reference numeral 80 is a pictorial segment for indicating the setting of the hand feed-in type paper cassette 29; reference numeral 81 is a pictorial segment for denoting the lower cover of the housing 1; reference numeral 82 is a pictorial segment for indicating that the upper cover is closed; reference numeral 83 is a pictorial segment for indicating that it is open; and reference numeral 84 is a pictorial segment for denoting the photosensitive drum 13.

Although it is not shown, a common electrode is provided on an opposite side of those segments, and when a voltage is applied between the common electrode and the respective segment, the latter is illuminated.

FIG. 3 shows a "paper size" display using the above-mentioned segments 53 to 61. Reference numeral 50 is the liquid crystal display panel and reference numeral 85 is a seal on which the sizes of the paper sheets P are printed. The seal 85 adheres to the side edge of the liquid crystal display panel 50 corresponding to the segments 53 to 59. The paper sizes are printed on the predetermined positions of the seal 85 corresponding to the segments 53 to 59. Accordingly, by illuminating the segment corresponding to the paper size in the selected paper supply cassette the paper size can be indicated. For example, when the paper supply cassette storing A-4 sized paper is selected, the segment 55 is illuminated. In this embodiment, segments 60 and 61 are spares.

Description will now be made of a display apparatus including the above-mentioned display panel 50, according to the invention, with reference to FIGS. 2 and 4.

FIG. 4 is a diagram of a display control circuit which may illuminate various segments as shown in FIG. 2. In this drawing, reference numeral 37 is a central processing unit (referred to "CPU" hereinafter) which is constituted by, e.g., a microprocessor. The CPU 37 may control the above-mentioned copying machine 1, document supporter 36 and sorter 4, and may deliver a data signal having, e.g., 32 bits for indicating the various operation conditions to a first output terminal thereof. The CPU 37 may also deliver a latch signal to a second output terminal thereof and a clock signal to a third output terminal thereof. Reference numeral 38 denotes a display driving circuit. A first input terminal of the display driving circuit 38 receives the above-mentioned data signal, and a second input terminal thereof receives the above-mentioned clock signal. In this case, the data signal is supplied to the display driving circuit 38 in synchronism with the clock signal derived from the CPU 37. Réference numeral 39 is an oscillator which produces a pulse signal at an optimum frequency for driving the display element 35. This pulse signal is supplied as a drive pulse A to an input terminal DP 1 of the display driving circuit 38. The drive pulse A is inverted by an inverter 40 and is then supplied as a drive pulse B to an input terminal DP 2 of the driving circuit 38. Thus, this drive pulse B is complementary to the drive pulse A.

From the output terminals OT1~OT32 of the driving circuit 38, segment drive signals are output in accordance with the contents of the data signal applied to the first input terminal thereof; each segment drive signal is applied to each of the corresponding electrodes S1 to S32, and the complementary drive pulse B is applied to the common electrode 41. A liquid crystal element is employed as the display section 35. The above-described electrodes S1 to S32 in FIG. 4 correspond to segments 51 to 84 shown in FIG. 2 in a manner as represented in the following table. As can be easily seen from the table, only the electrode S30 is connected to three segments 80, 81 and 84.

TABLE 1

| Electrodes shown in FIG. 4 | Component segments shown in FIG. 2 | Electrodes shown in FIG. 4 | Component segments shown in FIG. 2 |
|---|---|---|---|
| $S_1$ | 51 | $S_{17}$ | 67 |
| $S_2$ | 52 | $S_{18}$ | 68 |
| $S_3$ | 53 | $S_{19}$ | 69 |
| $S_4$ | 54 | $S_{20}$ | 70 |
| $S_5$ | 55 | $S_{21}$ | 71 |
| $S_6$ | 56 | $S_{22}$ | 72 |
| $S_7$ | 57 | $S_{23}$ | 73 |
| $S_8$ | 58 | $S_{24}$ | 74 |
| $S_9$ | 59 | $S_{25}$ | 75 |
| $S_{10}$ | 60 | $S_{26}$ | 76 |
| $S_{11}$ | 61 | $S_{27}$ | 77 |
| $S_{12}$ | 62 | $S_{28}$ | 78 |
| $S_{13}$ | 63 | $S_{29}$ | 79 |
| $S_{14}$ | 64 | $S_{30}$ | 80,81,84 |
| $S_{15}$ | 65 | $S_{31}$ | 82 |
| $S_{16}$ | 66 | $S_{32}$ | 83 |

Figure 5:
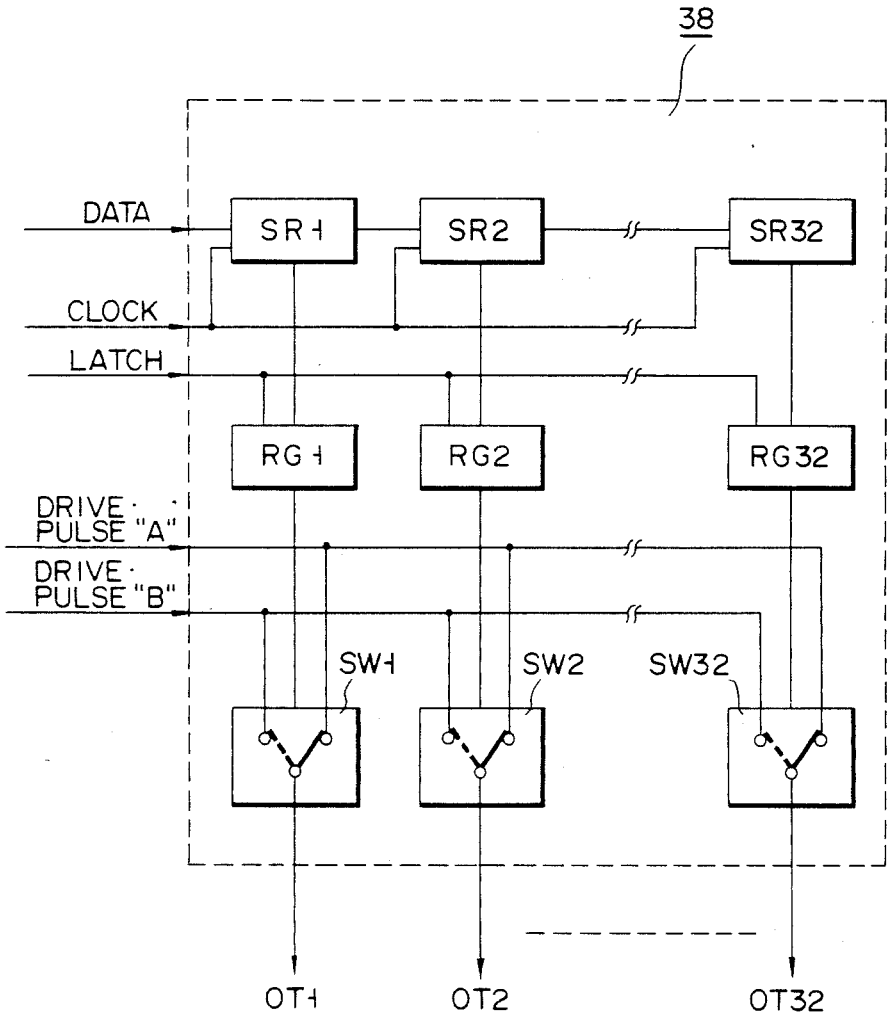
FIG. 5 is a functional logic diagram of the liquid crystal driving circuit.

FIG. 5 shows details of the display driving circuit 38. In the circuit, thirty-two shift registers SR1 to SR32 are cascade-connected, the data signal is applied to a first stage shift register SR1, and the clock signal is applied to each of the shift registers SR1 to SR32. Accordingly, the data signal derived from the first input terminal of the CPU 37 is transferred in turn from each shift register SR1 through SR32 in synchronized with the clock signal derived from the first input terminal. Storage registers RG1 to RG32 are directly connected to each shift register SR1 through SR32, which may store the contents of each shift register SR1 through SR32 by the latch signal derived from the third input terminal. The storage registers RG1 to RG32 may control to turn ON/OFF switches SW1 through SW32 in accordance with the contents stored therein, so that either the drive pulse A or the drive pulse B is selectively derived from output terminals OT1 through OT32 of the driving circuit 38. That is, when, for example, the content of the storage register is "1", the drive pulse A is derived from the output terminal, and when the content of the storage register is "0", the drive pulse B is derived from the output terminal.

Figures 6, 7:
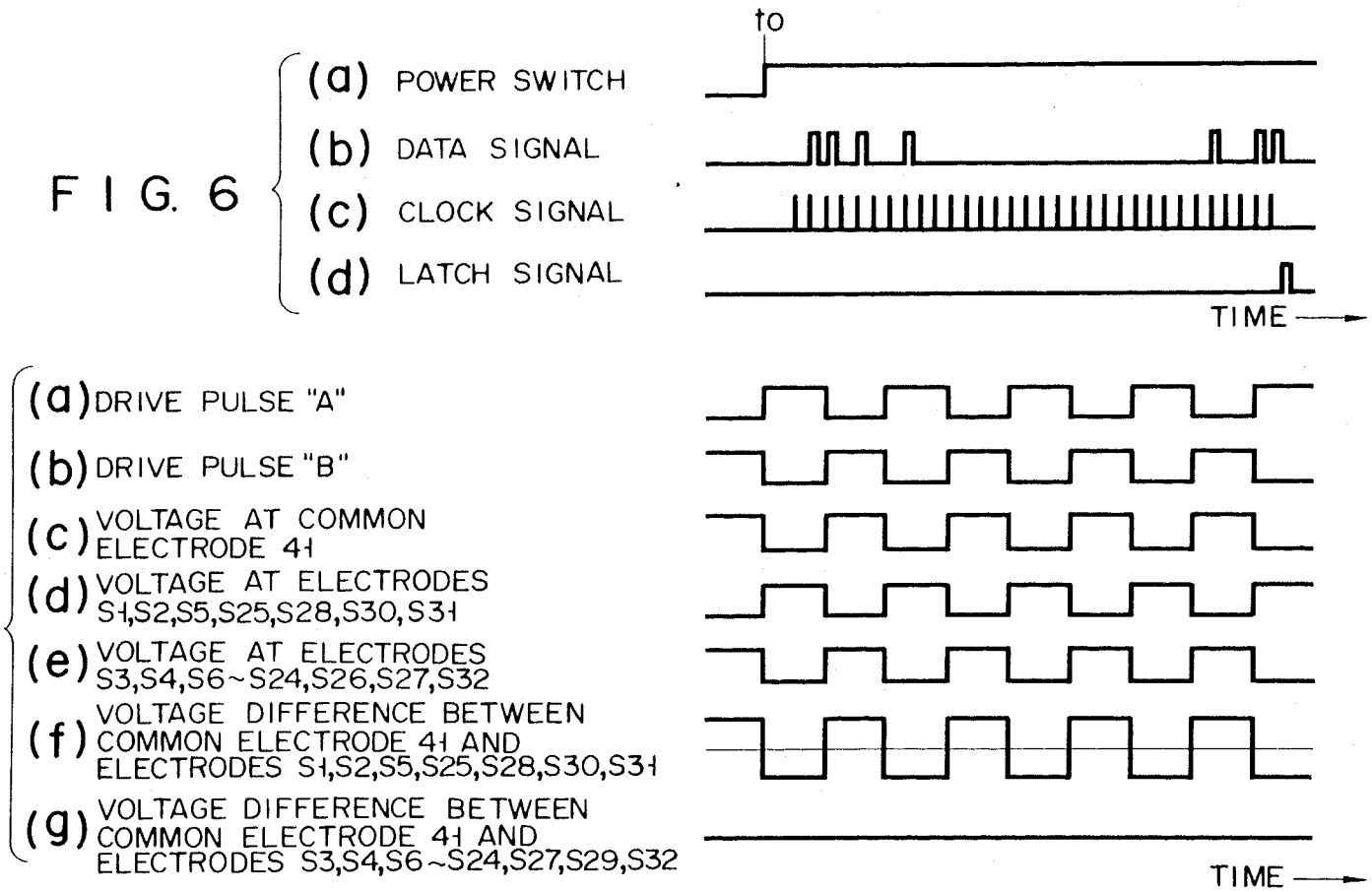
FIGS. 6, 9 and 12 are timing charts for explaining the paper convey operation of the display apparatus according to the invention.
FIGS. 7, 10 and 13 show waveforms of the voltages applied to the liquid crystal display panel.
Figure 8:
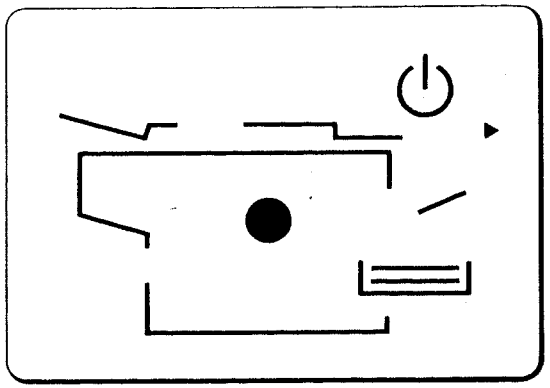
FIGS. 8, 11, 14, 15 and 16 show pictorial schematic diagrams of the display section for displaying the paper convey conditions of the liquid crystal display panel.
Figure 9:
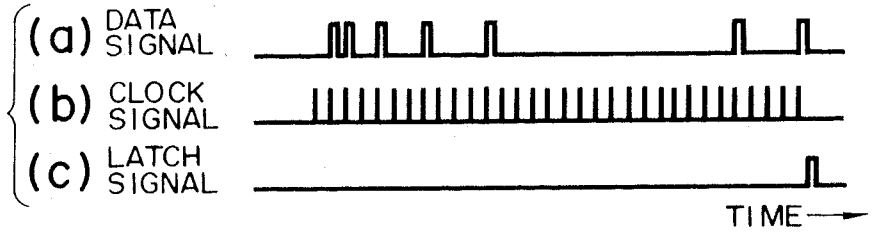
Figure 10:
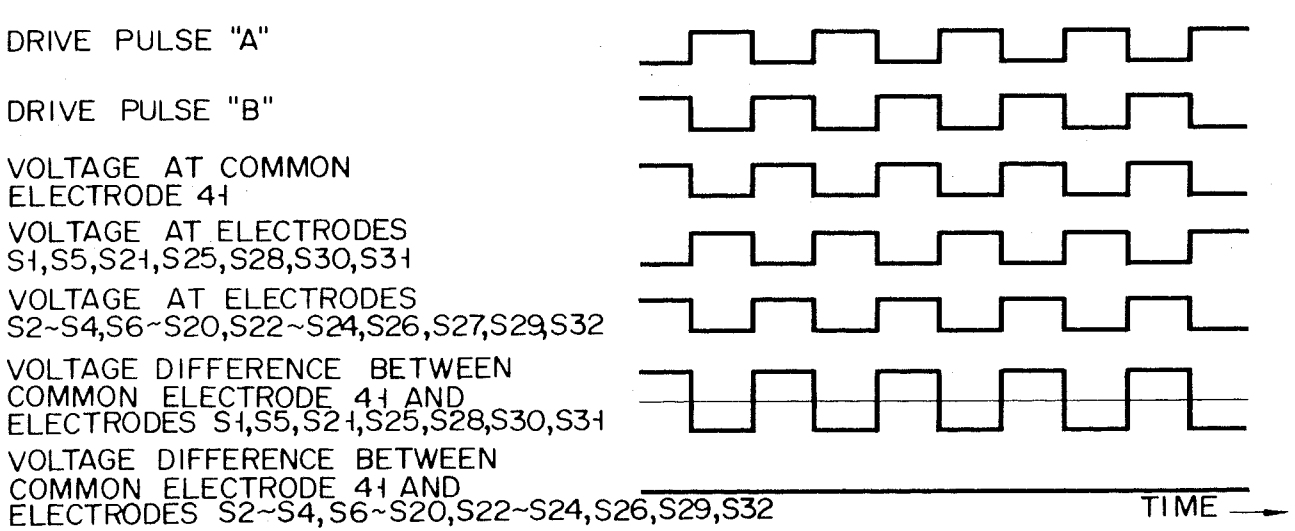
Figure 11:
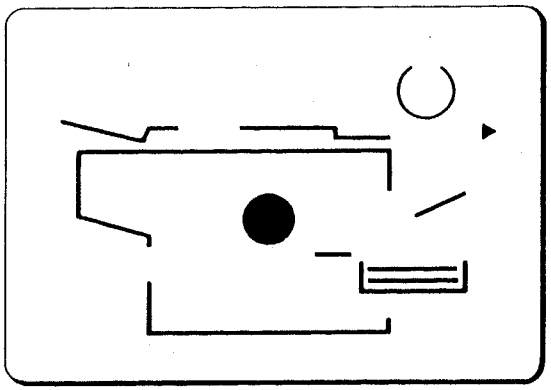
Figure 12:
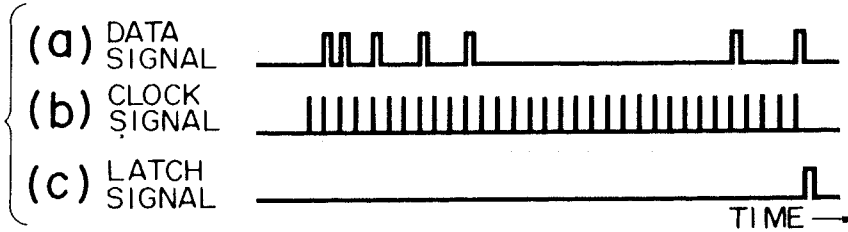
Figure 13:
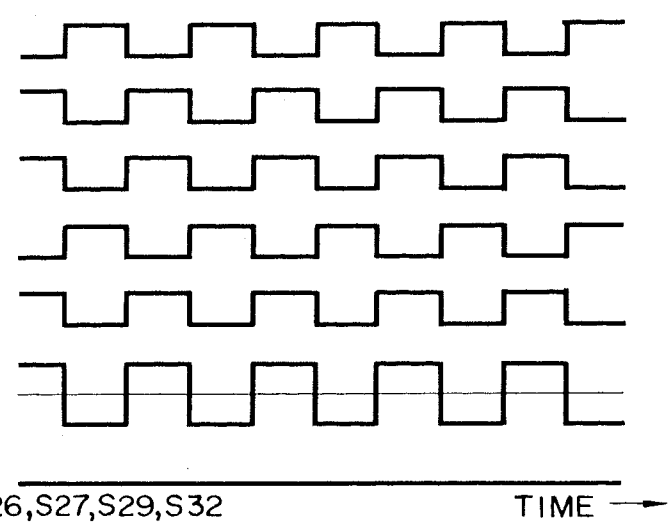

The operation of the above-mentioned embodiment will be explained with reference to FIGS. 6 through 16, in which FIGS. 6, 9 and 12 are timing charts, FIGS. 7, 10 and 13 show voltage waveforms that are to be applied to the liquid crystal display panel 50, and FIGS. 8, 11 and 14 to 16 show pictorial diagrams of the display panel.

A first condition where the copying machine 1 is turned ON and is not yet ready to use (i.e., the warming up condition) is explained with reference to FIGS. 6 through 8. It should be noted that in this case although the document supporter 36 is coupled to the copying machine 1, the sorter 32 is not attached. In FIG. 6, when the power switch (not shown) of the copying machine 1 is turned ON at an instant "to", the CPU 37 commences its operation in accordance with a predetermined program, and the internal heater of the fixing roller pair 26 is energized. Since at that instant a temperature of the fixing roller pair 26 does not yet reach the given fixing temperature, the data signal denoting the warming up condition, e.g., a 32-bit signal [11001000000000000000000010010100] is derived from the first output terminal. In this case, as previously explained, the data signal is output in synchronism with the clock signal derived from the second output terminal, the first bit signal is derived from the output terminal corresponding to the segment 84, and, after the 32nd bit signal is transferred, the latch signal is output from the third output terminal. As a result, the above-mentioned data signal is stored in the storage registers RG1 through RG12 in the driving circuit 38. Then the drive pulse A is derived from the output terminals OT1, OT2, OT5, OT25, OT28, OT30 and OT31 connected to the storage registers RG1, RG2, RG5, RG25, RG28, RG30 and RG31 respectively whose contents are "1", and therefore is applied to each of the electrodes S1, S2, S5, S25, S28, S30 and S31 as segment drive signals. The drive pulse B is derived from the output terminals OT3, OT4, OT6 to OT24, OT26, OT27, OT29 and OT32 corresponding to the storage registers RG3, RG4, RG6 to RG24, RG26, RG27, RG29 and RG32 whose contents are "0", and therefore is applied to each of the electrodes S3, S4, S6 to S24, S26, S27, S29 and S32 of the display panel 50 as an inverted segment drive signal. In this condition, since the drive pulse B is applied to the common electrode 41 of the liquid crystal display panel 50, an AC voltage as shown in FIG. 7*f* is applied between the common electrode 41 and the segments S1, S2, S5, S25, S28, S30 and S31. In other words, the AC voltage shown in FIG. 7*f* is equal to a difference on a potential of the electrodes against the potential of the common electrode 41. As a result, the electrodes S1, S2, S25, S28, S30 and S31, namely each segment 51, 52, 55, 78, 80 to 82 and 84 (FIG. 2), are illuminated. On the other hand, all electrodes except the above-mentioned electrodes, i.e., S3, S4, S6 to S24, S26, S27, S29 and S32, receive a voltage as shown in FIGS. 7*c* and 7*e*, which is in phase with the voltage applied to the common electrode 41, so that they are not energized because they have no potential difference, as shown in FIG. 7*g*. In other words, each of the segments 53, 54, 56 to 74, 76, 77, 79 and 83 are not illuminated. Consequently, the display panel 50 shows such a pictorial diagram in FIG. 8 to indicate that the copying machine 1 is in the warming-up condition.

After the above-described warming up operation of the copying machine 1, it becomes ready for copying. Under this condition the copying operation commences. Explanation will now be given with reference to FIGS. 9 to 11 for a case in which paper sheets P are positioned near the feed roller 18 or 19, or the register roller pair 22. A copying key (not shown) is depressed when the temperature of the fixing roller pair 26 reaches the predetermined fixing temperature. The paper sheet P is conveyed to either the feed roller 18 or 19, or the register roller pair 22. Under this condition, the CPU 37 may calculate the clock pulses of the timer as previously explained, so as to determine the present position of the paper sheet P, and thereafter deliver a data signal, e.g., [1000100000000000000100010010110] which indicates the present position. It should be noted that the CPU 37 can detect the present position of the paper sheet P under the control of the predetermined program by counting the clock pulses (derived from its internal timer) from the moment of depression of the copying key. As a result, since the storage registers RG2 to RG32 hold the above-mentioned data signal, the drive pulse A is delivered from the output terminals OT1, OT5, OT21, OT25, OT28, OT30 and OT31 that correspond to the storage registers RG1, RG5, RG21, RG25, RG28, RG30 and RG31 respectively whose contents are "1", said drive pulse A being applied to the respective electrodes S1, S5, S21, S25, S28, S30 and S31. On the other hand, the drive pulse B is output from the output terminals OT2 to OT4, OT6 to OT20, OT22 to OT24, OT26, OT27, OT29 and OT32 connected to the storage registers RG2 to RG4, RG6 to RG20, RG22 to RG24, RG26, RG27, RG29 and RG32, respectively, the contents of which are "0" and is then applied to the corresponding segments S2 to S4, S6 to S20, S22 to S24, S26, S27, S29 and S32. In this case, as the drive pulse B is applied to the common electrode 41 as in the prior example, an AC voltage as shown in FIG. 10*f* is to be applied between the common electrode 41 and the respective electrodes S1, S5, S21, S25, S29 and S32. Accordingly, the electrodes S1, S5, S21, S25, S28, S30 and S31, namely each segment 51, 55, 71, 75, 78, 82 and 84 are illuminated. Since the voltage whose phase is the same as one applied to the common electrode 41 shown in FIGS. 10(*c*) and 10(*e*), is applied to the remaining electrodes S2 to S4, S6 to S20, S22 to S24, S26, S27, S29 and S32, those electrodes i.e., the segments 52 to 54, 56 to 70, 72 to 74, 76, 77, 79 and 83 are not illuminated. This condition can be seen in the pictorial diagram in FIG. 11, in which the paper sheet P is present at the feed roller 18 or 19, or near the register roller pair 22 due to the illumination of both the outline of the copying machine 1 and the electrode S21 (the segment 71).

Figure 14:
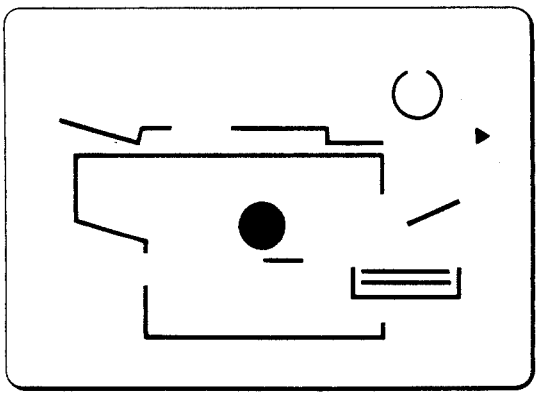

The description will now be given of the following condition. The paper sheet P is transported to the front of the photosensitive drum 13. When the paper sheet P reaches the front of the photosensitive drum 13, the CPU 37 may deliver a data signal for displaying the present position of the paper sheet P, e.g., [1000100000000000000010010010110]. Accordingly, as previously explained, an AC voltage is applied only between the common electrode 41 and the electrodes S1, S5, S22, S25, S28, S30 and S31, as shown in FIG. 13*f*, so that the segments corresponding to the above electrodes are illuminated and the remaining segments are not illuminated. This condition is shown in FIG. 14. That is, this pictorial diagram shows that the paper sheet P has reached the photosensitive drum 13 by illuminating the electrode S22 (the segment 72) together with the outline segments of the copying machine 1.

Figure 15:
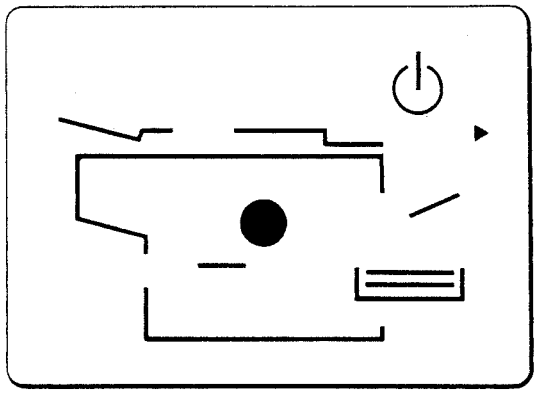
Figure 16:
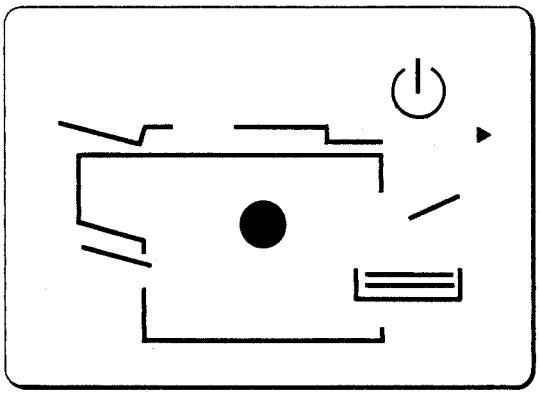

Similarly, when the paper sheet P reaches the paper convey path 25 or is near the delivery section 26, the electrode S22 (the segment 72 which was illuminated just before) is no longer energized and the electrode S23 (the segment 73) is no longer energized (shown in FIG. 15). Further, when the paper sheet P reaches the delivery tray, the electrode S23 (the segment 73 which was illuminated just before) is no longer energized and the electrode S24 (the segment 74) is energized (shown in FIG. 16). Thereafter, the electrode S24 is not energized so as to return to the waiting condition.

If the multiple copying operation is effected, the above-mentioned series of the operations will be continued.

In accordance with such a display apparatus, the following conditions may be easily seen on the display panel by illuminating in turn the segments 71 to 74 (the electrodes S21 to S24) in order to display the paper convey condition and also the outline segment of the copying machine 1.

Figure 18:
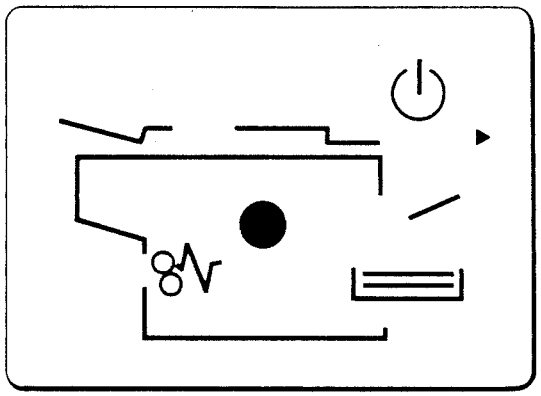
FIG. 18 shows a pictorial schematic diagram of the display section for displaying the paper jam.
Figure 17:
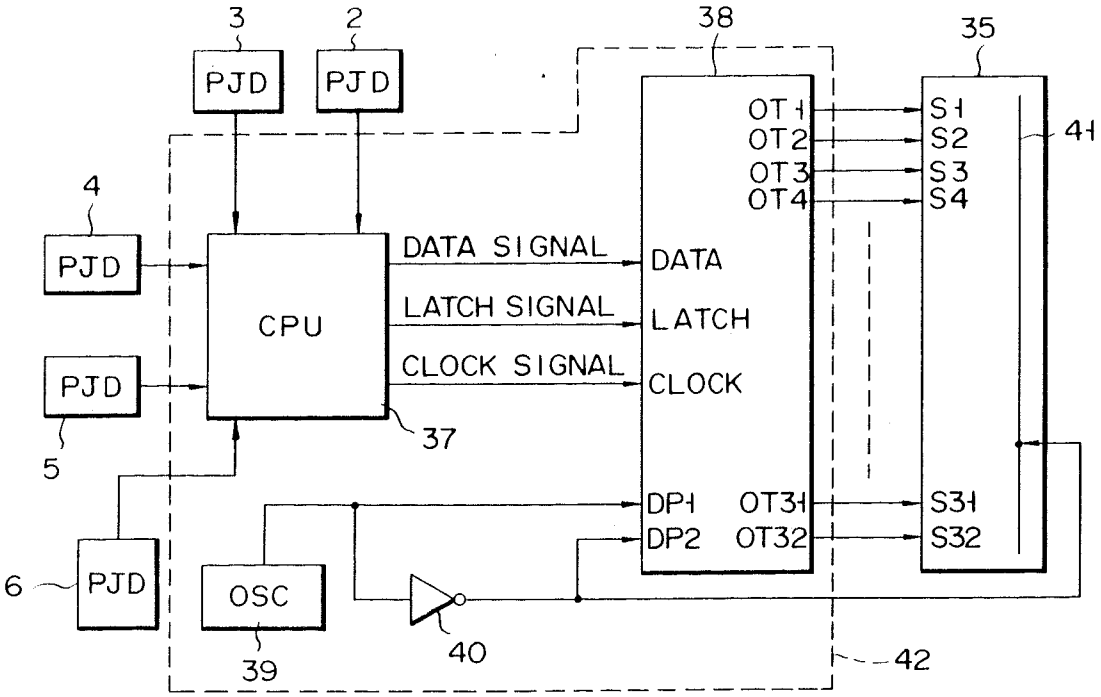
FIG. 17 is a functional logic diagram of the display control circuit combined with the paper jam detectors.

If a paper jam occurs, a paper jam signal derived from one of jam detectors 2 to 6 is supplied to the CPU 37 as shown in FIG. 17. Upon receipt of the jam signal this CPU 37 may correct the data signal produced in accordance with a given program based upon the above-mentioned paper jam signal so as to deliver new data signal. For example, if a signal is derived from the document feeder detector 2, a new data signal is produced in the CPU 37 to illuminate the segment 75 together with the outline segment of the copying machine 1. Similarly, new data signals are delivered from the CPU 37 in the case of the following paper jam problems. That is, the segment 68 is illuminated if the paper jam signal is detected by a hand feed-in type document detector 3, and the segments 67, 66 and 63 are illuminated if the paper jam signal is detected by a transfer detector 4, a fixer detector 5 and a delivery detector 6 respectively. In this case, the illumination of all segments 71, 72, 73 and 74 for displaying the paper convey condition is interrupted and the scanning operation of the display illumination is stopped. FIG. 18 shows the display panel 50 when the fixer detector 6 is actuated.

As explained hereinbefore, according to the present invention it is possible to provide a display apparatus in which the present position of the paper sheet P during the paper conveying process may be seen by graphic representation and the location of a paper jam may be also displayed. Consequently, the operator may visually check whether the paper convey device is being correctly operated or not, and which position within the machine requires repair.

The present invention is not restricted to the embodiments described above. Various modifications may be easily realized by those skilled in the art without departing from the technical scope and spirit of the invention. For example, although in the above-mentioned embodiments the segments 71 to 74 were illuminated in synchronism with the paper convey condition, similar effects can be obtained even if the illumination is not in synchronism with the paper convey condition. That is, during the copying operation the sequential illumination of the segments 71, 72, 73 and 74 in this order may be continued independent of the paper convey speed.

It is possible to arrange paper detectors at actual positions in the paper path corresponding to the above-mentioned segments 71, 72, 73 and 74, with the result that the paper jam positions may be clearly recognized. Furthermore if the segment corresponding to the paper jam flashes ON and OFF in case of a paper jam, it can more easily catch the attention of the operator. A lamp or a light emitting diode may be employed instead of the liquid crystal element.

Although the previous,embodiments were utilized in a copying machine, this in no way restricts the applications of the present invention. For example it is possible to utilize the display apparatus according to the invention in an image-forming apparatus which comprises pictorial display means and a paper convey path, e.g., a printer, a duplicator or a facsimile. There is no limitation to the uses of the pictorial display explained so far. The pictorial display apparatus can display the opertion of the copying machine when combined with only the document feeder, or only the sorter, or neither the document feeder nor the sorter.

What is claimed is:

1. A display apparatus incorporated in an image-forming apparatus in which images of documents are scanned by optical means and then the scanned images are formed as visible images on sheets of paper by electrophotographic means, said sheets of paper being moved along a predetermined path through said image-forming apparatus, comprising:

display means which pictorially displays component segments of said image-forming apparatus, said component segments defining at least said paper path and the outlines of said image-forming apparatus;

oscillating means for producing drive pulses and complementary drive pulses;

processing means from which a data signal is derived based upon a predetermined program, a latch signal and a clock pulse signal respectively; and display driving means which receives said drive pulses and said complementary drive pulses so as to drive said display means under the control of said data signal, whereby said processing means controls said display means to display on said component segments a present position of sheets of paper in synchronism with the paper movement by calculating said clock pulse signal.

2. A display apparatus incorporated in an image-forming apparatus in which images of documents are scanned by optical means and then the scanned images are formed as visible images on sheets of paper by electrophotographic means, said sheets of paper being moved along a predetermined path through said image-forming apparatus, comprising:

display means which pictorially displays component segments of said image-forming apparatus, said component segments defining at least said paper path, and the outlines of said image-forming apparatus;

oscillating means for producing drive pulses and complementary drive pulses;

processing means from which a data signal is drived based upon a predetermined program, a latch signal and a clock pulse signal respectively; and display driving means which receives said drive pulses and said complementary drive pulses so as to drive said display means under the control of said data signal, whereby said processing means controls said display means to display on said component segments a flow of sheets of paper during the paper movement.

3. A display apparatus incorporated in an image-forming apparatus as claimed in claim 1, wherein said display driving means includes:

a plurality of shift registers which are laterally connected to receive said data signal from said processing means under the control of said clock signal;

a plurality of storage registers which are connected to said plurality of shift registers respectively so as to store said data signal upon receipt of said latch signal; and a plurality of switching members which switch to deliver one of said drive pulses and said complementary drive pulses to said display means in accordance with the storage condition of said respective storage register.

4. A display apparatus incorporated in an image-forming apparatus as claimed in claim 2, wherein said display driving means includes:

a plurality of shift registers which are laterally connected to receive said data signal from said processing means under the control of said clock signal;

a plurality of storage registers which are respectively connected to said plurality of shift registers so as to store said data signal upon receipt of said latch signal; and a plurality of switching members which switch to deliver one of said drive pulses and said complementary drive pulses to said display means in accordance with the storage condition of said storage registers.

5. A display apparatus incorporated in an image-forming apparatus as claimed in claim 1, wherein: said display apparatus further comprises a paper jam detector provided at least along said paper path, and said component segments of the display means further define a paper jam malfunction area, whereby when said paper jam detector is actuated, said component segment of the paper jam malfunction area is illuminated while illumination on all component segments of the paper path is stopped.

6. A display apparatus incorporated in an image-forming apparatus as claimed in claim 2, wherein said display apparatus further comprises a paper jam detector provided at least along said paper path, and said component segments of the display means further define a paper jam malfunction area, whereby when said paper jam detector is actuated, said component segment of the paper jam malfunction area is illuminated while illumination on all component segments of the paper path is stopped.

7. A display apparatus incorporated in an image-forming apparatus as claimed in claim 1, wherein:

said display means is a liquid crystal display device.

8. A display apparatus incorporated in an image-forming apparatus as claimed in claim 2, wherein:

said display means is a liquid crystal display device.

* * * * *